US006951056B2

(12) United States Patent
Kameoka et al.

(10) Patent No.: US 6,951,056 B2
(45) Date of Patent: Oct. 4, 2005

(54) ELECTRIC RAZOR INNER BLADE UNIT

(75) Inventors: Hiroyuki Kameoka, Hikone (JP); Masaaki Satou, Oumihachiman (JP); Shunsuke Komori, Hikone (JP); Toshio Ikuta, Hikone (JP); Tadashi Hamada, Sakai (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 10/477,749

(22) PCT Filed: Aug. 2, 2002

(86) PCT No.: PCT/JP02/07936

§ 371 (c)(1),
(2), (4) Date: Nov. 24, 2003

(87) PCT Pub. No.: WO03/016000

PCT Pub. Date: Feb. 27, 2003

(65) Prior Publication Data

US 2004/0123466 A1 Jul. 1, 2004

(30) Foreign Application Priority Data

Aug. 10, 2001 (JP) ..... 2001-244629

(51) Int. Cl.[7] ..... B26B 19/04
(52) U.S. Cl. ..... 30/346.51; 30/43.92
(58) Field of Search ..... 30/346.54, 43.92, 30/346.51, 350; 76/104.1, DIG. 8

(56) References Cited

U.S. PATENT DOCUMENTS

| | | | | | |
|---|---|---|---|---|---|
| 2,244,053 | A | * | 6/1941 | Comstock | 428/546 |
| 3,064,349 | A | * | 11/1962 | Futterer et al. | 30/43.92 |
| 3,756,105 | A | | 9/1973 | Balamuth et al. | |
| 4,343,089 | A | * | 8/1982 | Suzuki et al. | 30/346.51 |
| 4,451,984 | A | | 6/1984 | Shimazu | |
| 4,575,941 | A | | 3/1986 | Packham | |
| 5,056,227 | A | * | 10/1991 | Kramer | 30/346.54 |
| 5,129,289 | A | * | 7/1992 | Boland et al. | 76/104.1 |
| 5,142,785 | A | * | 9/1992 | Grewal et al. | 30/32 |
| 5,669,144 | A | * | 9/1997 | Hahn et al. | 30/346.54 |
| 5,857,260 | A | * | 1/1999 | Yamada et al. | 30/346.51 |

FOREIGN PATENT DOCUMENTS

| | | |
|---|---|---|
| EP | 743144 | 11/1996 |
| JP | 1-13392 | 3/1989 |
| JP | 1-25590 | 5/1989 |
| JP | 2-46839 | 12/1990 |
| JP | 6-257 | 1/1994 |
| JP | 6-142347 | 5/1994 |
| JP | 8-196752 | 8/1996 |
| JP | 10-328434 | 12/1998 |

* cited by examiner

*Primary Examiner*—Douglas D Watts
(74) *Attorney, Agent, or Firm*—Oblon, Spivak, McClelland, Maier & Neustadt, P.C.

(57) ABSTRACT

An inner cutter for a dry shaver has a plurality of blades 30 supported on a base 20 and is driven in hair-shearing engagement with an outer cutter 10 for cutting the hairs. The blades 30 are arranged in parallel with each other and are each provided on opposite sides at its top with cutting edges 32. The cutting edge 32 is defined between the top face of the blade and a rake fade 33 on the underside of the blade. The rake face 33 is inclined with respect to the top face at an angle of $\alpha$ (°), while the cutting edge is rounded at its tip to have a curvature radius R ($\mu$m) which satisfies a relation that $R \geqq -0.067 \cdot \alpha + 4.7$. With this result, the cutting resistance for cutting the hair can be lowered below a load necessary for bending the hair. Thus, the blade of the inner cutter can itself cut the hair without bending the hair, giving a flat cutting plane finish and enabling a close shave only with a fewer shaving strokes.

7 Claims, 4 Drawing Sheets

ELECTRIC RAZOR INNER BLADE UNIT

TECHNICAL FIELD

The present invention relates to an inner cutter for a dry shaver, and more particularly to the inner cutter having a plurality of blades arranged in parallel with each other for use in an oscillatory type electric shaver.

BACKGROUND ART

The electric shaver has a cutter head composed of an outer cutter having a number of hair-introducing apertures and an inner cutter provided with a plurality of blades. The inner cutter is connected to a driving source to be driven to oscillate relative to the outer cutter. As disclosed in Japanese Early Patent Publication No. 6-142347, the blade for use in the conventional inner cutter is configured to have an undercut in a side face adjacent to the top of the blade to give a cutting edge having a suitable knife angle so that, as shown in FIG. 11A, the cutting edge 32 at top of the blade 30 can shear the hairs H introduced through the aperture 11 of the outer cutter 10 against the cutter edge of outer cutter 10. In this case, as shown in FIG. 11B, the hair H introduced through the center region of the aperture 11 is sheared only after it is bent and shifted against the cutter edge of the outer cutter 10. Thus, the hairs is cut while it is bent down by the cutting edge 32 of the blade 30, and therefore suffers from inclined cutting planes, as shown in FIG. 11, failing to make a close shaving. With this problem, the prior dry shaver has to be manipulated to move over and over relative to the hair in order to make the close shave, and accordingly requires much shaving time.

DISCLOSURE OF THE INVENTION

The present invention has been achieved in view of the above problem to provide an inner cutter for the dry shaver which is capable of cutting the hairs without bending them by the inner cutter irrespective of the conditions of the hairs introduced through the apertures of the outer cutter, and therefore making the close shave at a reduced stroke.

The inner cutter for a dry shaver in accordance with a present invention includes a plurality of blades 30 which are supported on a base 20 and are driven to move relative to an outer cutter 10 in hair shearing engagement with the outer cutter for cutting the hairs. The blades are arranged in parallel with each other and are each provided on opposite sides at the upper end thereof with cutting edges 32. The cutting edge is defined by a top face of the blade and a rake face 33 formed on the underside of the blade. The rake face 33 is inclined with respect to the top face at an angle of $\alpha$ (°). The cutting edge is rounded at its tip to have a radius of curvature R ($\mu$m) which satisfies a relation that $R \leqq -0.067 \cdot \alpha + 4.7$. With this arrangement, it is possible to lower cutting resistance at the time of cutting hairs below a load required to bend the hairs. Whereby the hair introduced in any portion of the hair introducing aperture can be cut only by the action of the blade of the inner cutter without being bent, which brings about a flat cutting plane at the section of the hair and therefore enables a close shave at a small number of shaving strokes.

Preferably, each of the blades 30 includes a rib 34 which projects on the underside of the blade such that the cutting edges 32 project sideward from an upper end of the rib 34 by an amount of at least 0.05 mm. By provision of the rib 34 on the underside of the blade 30, and taking into account that the hair has normally a diameter of 0.1 mm, the cutting edge can be made to have a projection length, one-half or more of the hair's diameter. Accordingly, until the cutting edge 32 cuts the hair by ½ or more of its diameter, the portion other than the cutting edge can be kept away from the hair and does not act to bend the hair. Thus, the cutting edge can cut the hair without bending the same, assuring to cut the hair successfully.

It is preferred that each blade 30 is formed in its top face with a recess 38 or projection 39 extending along a length of the blade. The recess or projection can reduce a shearing contact area with the outer cutter, thereby reducing shearing load and the associated temperature increase.

Further, each blade is formed on its rake face 33 with a hardened layer 35 that is responsible for elongating sharpness life of the cutting edge.

The inner cutter having the unique cutter edges of the present invention can be adapted for use in the shaver of not only an oscillatory type but also a rotary or other type.

When using the inner cutter having the blades is driven to oscillate, it is preferred to move at a speed of 0.5 m/sec or more.

BEST MODE FOR CARRYING OUT THE INVENTION

Figure 1:
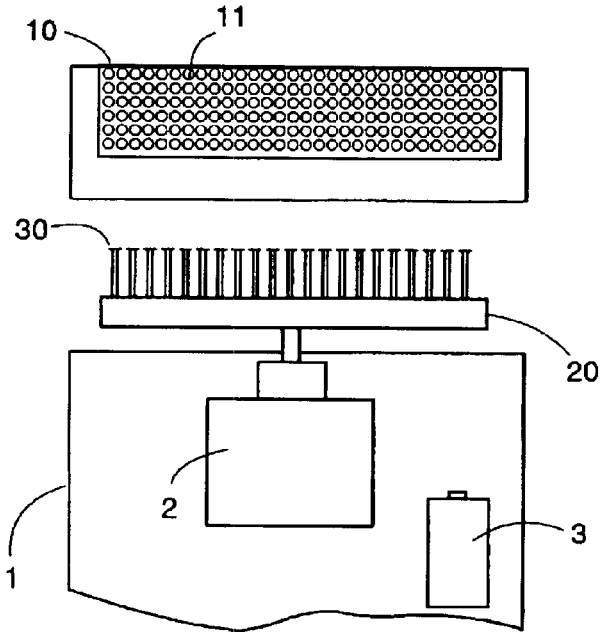
FIG. 1 is an exploded view of a dry shaver to which the inner cutter of the present invention is applied.

One embodiment of the present invention will be discussed with reference to the attached drawings. The inner cutter for the dry shaver in accordance with the present invention is applied to the shaver of oscillatory type, as shown in FIG. 1, and includes a plurality of blades 30 arranged in a parallel relation with each other on a base 20 of a synthetic resin. The base is connected to a driving source, for example, a motor 2 incorporated in a housing 1 to oscillate the inner cutter relative to an outer cutter 10. The outer cutter 10 has a number of hair introducing apertures 11 entrapping therein the hairs which are to be cut by the blades 30. The outer cutter 10 is secured to the upper end of the housing 1. The inner cutter projecting on the upper end of the housing 1 is driven to oscillate in a direction perpendicular to cutting edges of each blade 30 as discussed later, while being kept in contact with the inside surface of the outer cutter 10. The housing 1 accommodates a battery 3 together with the motor 2 for supplying an electric power to the motor 2. The housing 1 is shaped to be grasped by a user's hand.

Figure 2:
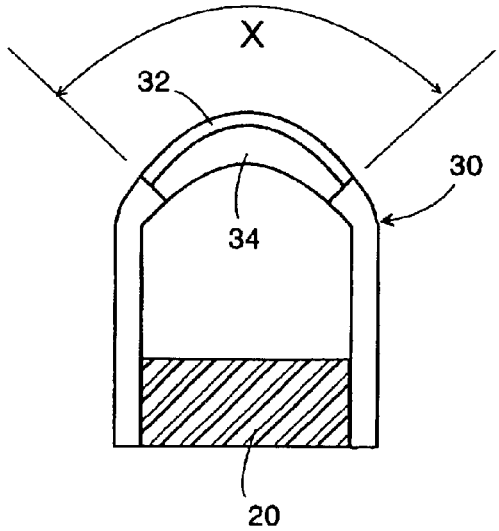
FIG. 2 is side sectional view of the inner cutter.
Figure 3:
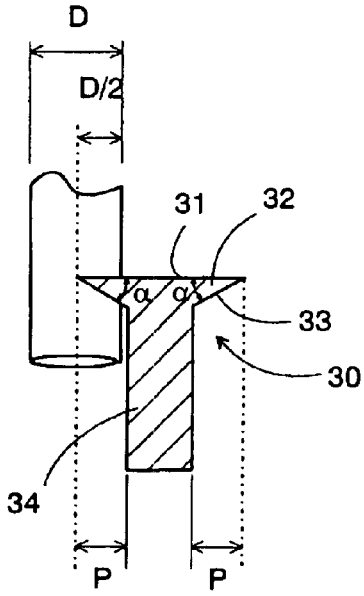
FIG. 3 is a cross-section of a blade forming the inner cutter.

As shown in FIG. 2, each blade 20 is curved into an approximately U-shaped configuration and is secured at its opposite ends to the base 20. The cutting edge 32 is formed over a predetermined angular range X, for example, about 100° along an arcuate portion at the center of the blade. The arcuate portion is held in contact with the underside of the similarly shaped outer cutter 10. As shown in FIG. 3, a rib 34 project downward from the center portion of the blade 30 with the cutting edges 32 projecting sideward from the upper end of the rib 32.

The cutting edge 32 is defined between the upper face 31 of the blade and a rake face 33 extending from the upper end of the rib 34 in an inclined relation to the upper face of the blade at a knife angle of $\alpha$ (°), and gives at its tip a curvature radius R ($\mu$m) which satisfies a relation that $R \leqq -0.067 \cdot \alpha + 4.7$.

Figure 4A:
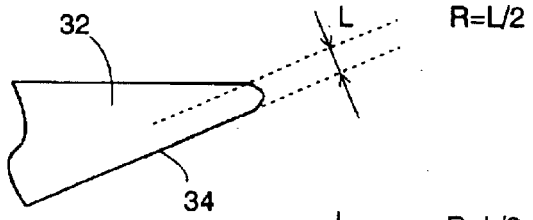
FIGS. 4A, 4B, and 4C are explanatory views showing a scheme of determining a curvature radius for the cutting edge of the blade.
Figure 4B:
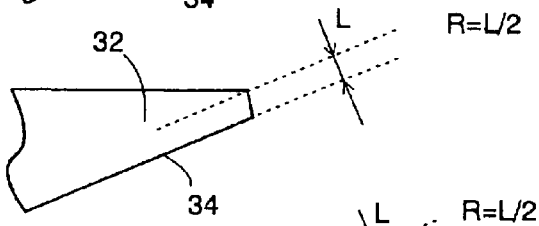
Figure 4C:
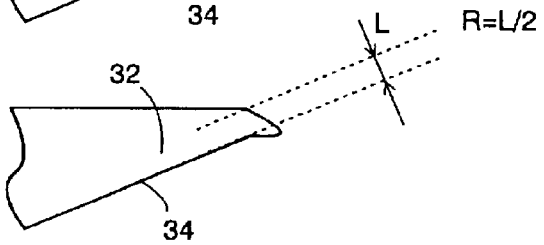

The cutting edge 32 is likely to have the configurations of FIGS. 4A to 4C depending upon the degree of finish. Thus, the curvature radius R of the cutting edge is determined in the present invention by approximation of effective minimum thickness L of the knife edge (R=L/2). That is, with regard to the configurations shown in FIGS. 4A to 4C, the effective minimum length L is defined to be an interval between an extension of the rake face 34 and a parallel extension passing through an inflection point at the cutting edge on the upper face of the blade, giving the curvature radius R (R=L/2).

Figure 5:
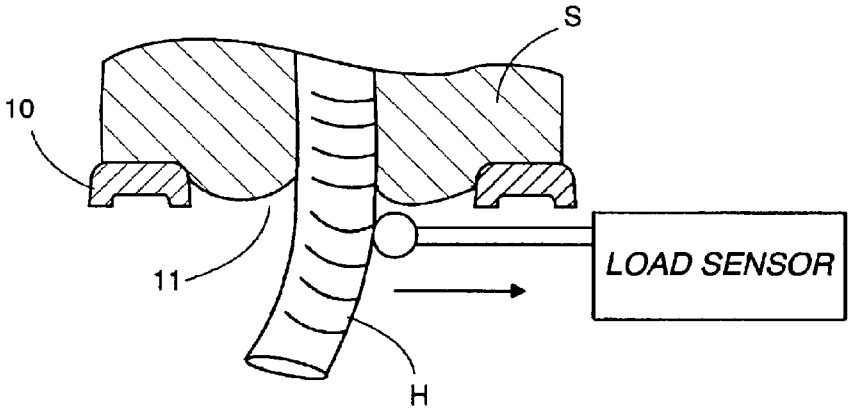
FIG. 5 is an explanatory view showing a scheme of measuring a load necessary in the hair.

In determining the relation between the knife angle $\alpha$ (°) and the curvature radius R ($\mu$m), it is firstly made to examine the behavior of the hair being cut. As shown in FIG. 5, when the outer cutter 10 of the dry shaver is pressed against the skin S, the hair H introduced through the center of the hair introducing aperture 11 becomes to have its periphery constrained by the outer cutter 10, and is therefore elastically supported by the skin S projecting into the aperture 11. In this condition, a load F necessary to bend the hair is measured by use of a load sensor C. Thus, it is known that the hair can be cut without being bent when the cutting resistance at the time of cutting the hair H is reduced below the load F. The cutting resistance is affected by the knife angle $\alpha$ (°) of the blade 30, the curvature radius R ($\mu$m) of the cutting edge, and the cutting speed. In view of this, the present invention gives a finding as to a correlation between the knife angle $\alpha$ (°) and the curvature radius R ($\mu$m) for reducing the cutting resistance below the load F at the condition of the cutting speed of the inner cutter of a normal dry shaver.

Figure 8A:
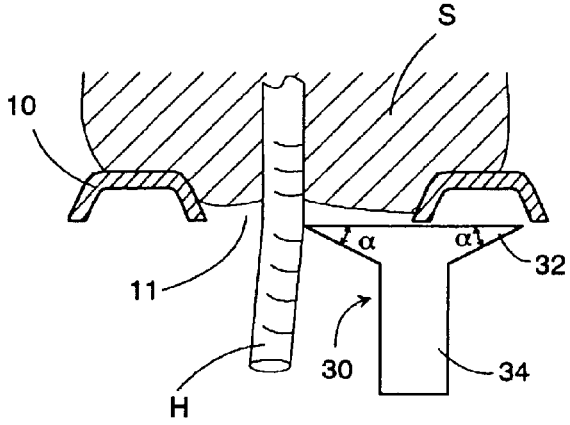
FIGS. 8A and 8B are explanatory views showing the cutting of the hairs by the inner cutter.
Figure 8B:
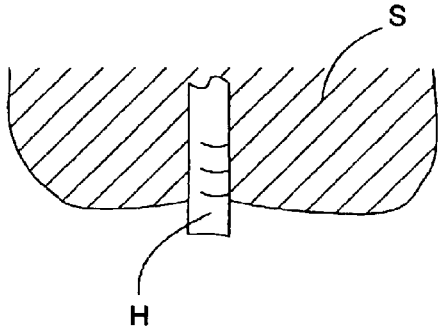
Figure 6:
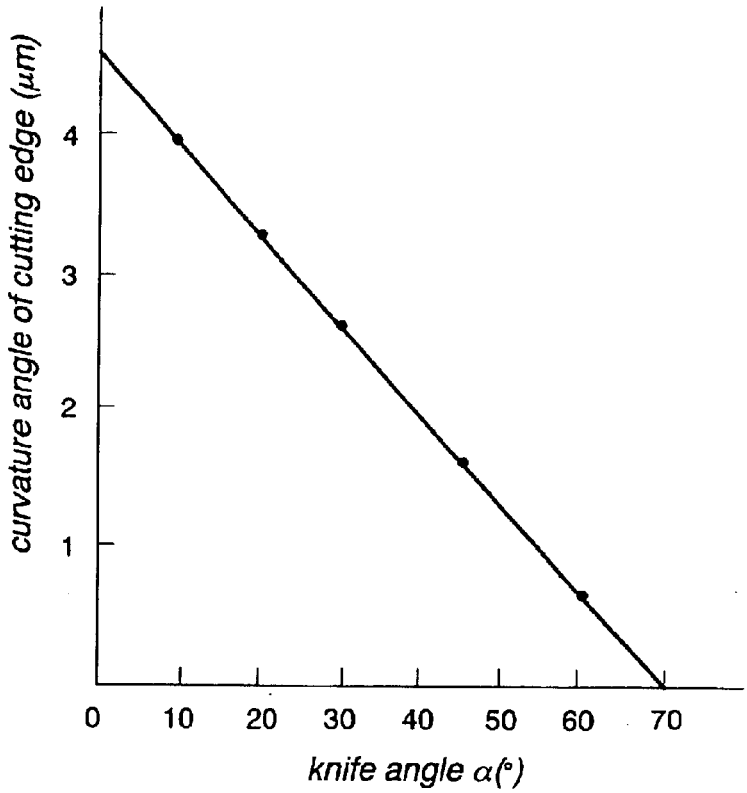
FIG. 6 is a graph showing a relation between the knife angle of the cutting edge and the curvature radius at the tip of the cutting edge to give a cutting resistance of 20 grf when the inner cutter 3 is driven at the cutting speed of 0.5 m/sec.
Figure 11A:
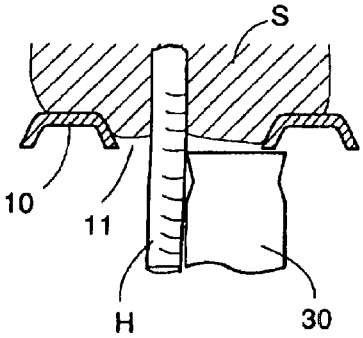
FIGS. 11A, 11B, and 11C are explanatory views showing the cutting of the hairs by the conventional inner blade of the dry shaver.
Figure 11B:
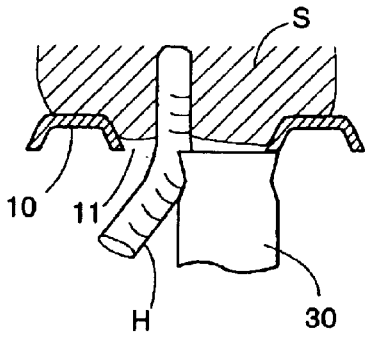
Figure 11C:
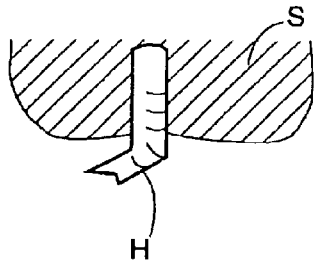

Experiment shows that the load F for bending the hair H is 20 grf (F=20 grf), and that the cutting resistance decreases with the increasing cutting speed. The cutting speed of the inner cutter of the normal dry shaver is about 0.5 m/sec or more, i.e, the lowest cutting speed of the inner cutter of the normal dry shaver is about 0.5 m/sec. FIG. 6 shows a relation obtained by experiment between the knife angle $\alpha$ (°) and the curvature radius R ($\mu$m) to satisfy the cutting resistance of 20 grf. The relation can be expressed by $R=-0.067 \cdot \alpha + 4.7$ for attaining the cutting resistance of 20 grf. Thus, the inner cutter with the blades having the knife angle $\alpha$ (°) and the curvature radius R ($\mu$m) that satisfy the area below the line expressed by $R=-0.067 \cdot \alpha + 4.7$ can be found to cut the hair by itself without bending the hair, thereby enabling a close shave only at a fewer number of shaving strokes. It is noted in this connection that since the cutting resistance will be lowered as the cutting speed of the inner cutter increases, the inner cutter having the cutting speed of more than 0.5 m/sec has its cutting resistance lowered and therefore apparently satisfies the above relation. With this result, with regard to all the cutting speeds that the general dry shavers give, the blade of the inner cutter can successfully cut the hair H introduced through the aperture 11 of the outer cutter 10, as shown in FIGS. 8A and 8B. Thus, the hair H is give a flat cutting plane, as shown in FIG. 8B, enabling to make a close shave in comparison with the prior art shown in FIG. 11C in which the hair H is cut inclined.

Figure 7:
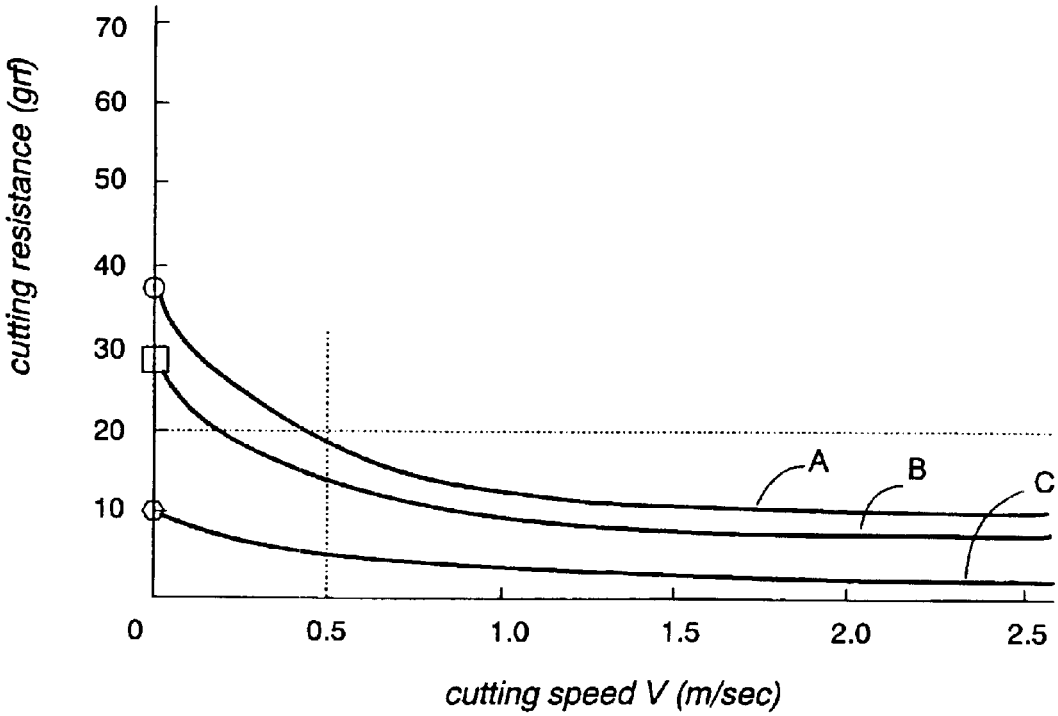
FIG. 7 is a graph showing a relation between the cutting speed and the cutting resistance of the inner cutter.

FIG. 7 is a graph illustrating a relation between the cutting resistance and the cutting speed for three examples satisfying the expression $R \leqq -0.067 \cdot \alpha + 4.7$ with regard to the relation between the knife angle the knife angle $\alpha$ (°) and the curvature radius R ($\mu$m) of the cutting edge 4 of the inner cutter 3 (line A for the knife edge of 40° and R=2 $\mu$m; line B for the knife edge of 30° and R=2 $\mu$m; and line C for the knife edge of 20° and R=2 $\mu$m). As apparent from the graph, all the lines A, B, and C show that the cutting resistance is below 20 grf when the cutting speed of the inner cutter is 0.5 m/sec, which demonstrates that the inner cutter can alone cut the hair without bending the hair. Also it is apparent that the cutting resistance is lowered as the cutting speed increases, and that the cutting resistance is kept below 20 grf for any one of the lines A, B, and C as the cutting speed increases from 0.5 m/sec, assuring that the inner cutter 3 alone can cut the hairs without bending it.

It is noted that the cutting edges 32 each of the opposite sides at the top of the blade 30 is made to have a projecting amount P of 0.05 mm or more. The reason is as follows. The normal hair has a diameter D of about 0.1 mm. As shown in FIG. 3, when the cutting the hair H by use of the blade 30, the rib 34 is kept free from the hairs until the hair is cut by a half or more of its diameter, and therefore will not abut against and bend the hair H until the hair is cut by the half or more of its diameter. The rib comes into contact with the hair only after the hair is cut by the half or more of its diameter, which results in that the hair can be cut without being bent.

Figure 9:
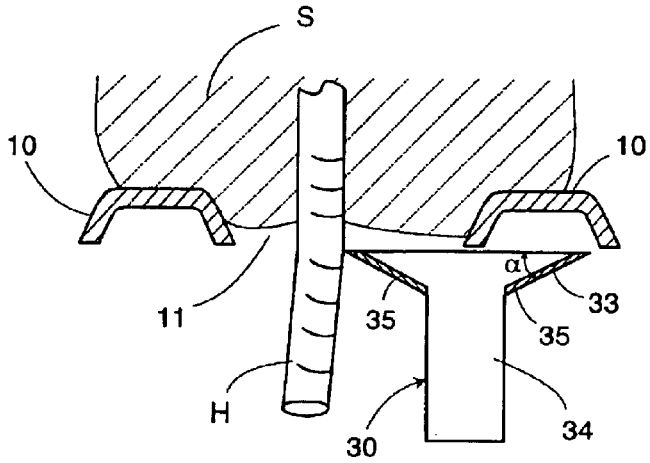
FIG. 9 is a sectional view showing an embodiment in which the blade is formed with hardened layers.

As shown in FIG. 9, the rake face 33 constituting the cutting edge 32 may be deposited with a hardening layer 35 in order to prevent the wearing of the cutting edge 32 for elongating the life of sharpness. The hardened layer 35 may be formed integrally by cladding titanium and aluminum foils, a heat treatment such as by laser beam hardening and impact hardening, or even by depositing a coating of TiN, TiC, CrN, or hardened carbon membrane. The hardened layer 35 may be formed on top face of the blade 30 in addition to the rake face 33.

Figure 10A:
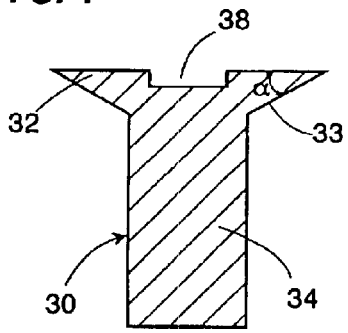
FIGS. 10A and 10B are sectional views illustrating modifications of the above blade.
Figure 10B:
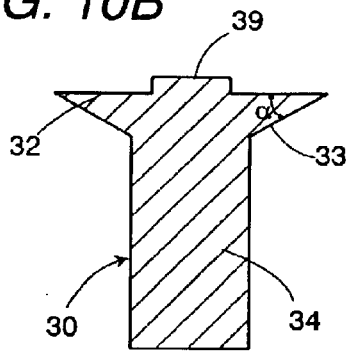

Further, as shown in FIGS. 10A and 10B, the blade 30 may be formed on its face with a recess 38 or projection 39 that extends along a length of the blade for the purpose of reducing the sliding resistance against the outer cutter 10 and the therefore the sliding load as well as the associated temperature increase.

The blade for use in the inner cutter in accordance with the present invention is applied to not only the dry shaver of oscillatory type but also to dry shavers of other types in which the blade having above-mentioned unique cutting edge can improve hair cutting efficiency.

What is claimed is:

1. An inner cutter for a dry shaver comprising:

a plurality of blades which are supported on a base and driven to move relative to an outer cutter in hair shearing engagement with the outer cutter for cutting hairs;

said blades being arranged in parallel relation with each other and shaped to have a pair of cutting edges on opposite sides on top of each blade, said cutting edge being defined by a top face of said blade and a rake face which is formed on an underside of said blade and which is inclined with respect to said top face at an angle of $\alpha$ (°) said cutting edge being rounded at its tip to have a curvature radius R ($\mu$m) which satisfies a relation that $R \leqq -0.067 \cdot \alpha + 4.7$, wherein each of said blades includes a rib which projects on the underside of the blade such that said cutting edges project sideward from an upper end of said rib by an amount of at least 0.05 mm.

2. The inner cutter as set forth in claim 1, wherein each of said blades is formed in its top face with a recess extending along a length of the blade.

3. The inner cutter as set forth in claim 1, wherein each of said blade is formed on its top face with a projection extending along a length of the blade.

4. The inner cutter as set forth in claim 1, wherein each of said blade is formed on said rake face with a hardened layer.

5. A blade for use in an inner cutter of a dry shaver, said blade having a cutting edge and being supported to a base with said cutting edge upward to form the inner cutter, said inner cutter being driven to move in sliding contact with an outer cutter formed into a thin foil having hair-introducing apertures in order to cut the hairs introduced through said apertures by shearing engagement between the outer cutter and the cutting edge, said cutting edge being defined by a top face of said blade and a rake face which is formed on an underside of said blade and which is inclined with respect to said top face at an angle of $\alpha$ (°), said cutting edge being rounded at its tip to have a radius of curvature R ($\mu$m) which satisfies a relation that $R \leqq -0.067 \cdot \alpha + 4.7$, wherein each of said blades includes a rib which projects on the underside of the blade such that said cutting edges project sideward from an upper end of said rib by an amount of at least 0.05 mm.

6. A dry shaving comprising:

said inner cutter defined in claim 1;

a housing to be grasped by a hand and carrying said inner cutter on it top, said housing accommodating a motor for deriving said inner cutter and a battery supplying an electric power to said motor; and;

an outer cutter disposed on top of said housing and being shaped from a thin foil having hair-introducing apertures;

wherein said inner cutter is driven to oscillate relative to said outer cutter in a direction perpendicular to said cutting edge.

7. The dry shaver as set forth in claim 6, wherein said inner cutter oscillates at a speed of 0.5 m/sec or more.

* * * * *

UNITED STATES PATENT AND TRADEMARK OFFICE

CERTIFICATE OF CORRECTION

PATENT NO. : 6,951,056 B2
DATED : October 4, 2005
INVENTOR(S) : Kameoka et al.

It is certified that error appears in the above-identified patent and that said Letters Patent is hereby corrected as shown below:

Title page, Item [54] and Column 1, line 1,
Title, should read -- INNER CUTTER FOR A DRY SHAVER --.

Signed and Sealed this

Thirteenth Day of December, 2005

JON W. DUDAS
*Director of the United States Patent and Trademark Office*